US008621666B2

(12) United States Patent
Crye

(10) Patent No.: US 8,621,666 B2
(45) Date of Patent: Jan. 7, 2014

(54) GARMENT PROTECTIVE ASSEMBLY

(75) Inventor: Caleb Clark Crye, Brooklyn, NY (US)

(73) Assignee: Lineweight LLC, Brooklyn, NY (US)

( * ) Notice: Subject to any disclaimer, the term of this patent is extended or adjusted under 35 U.S.C. 154(b) by 472 days.

(21) Appl. No.: 12/699,804

(22) Filed: Feb. 3, 2010

(65) Prior Publication Data

US 2010/0223709 A1 Sep. 9, 2010

Related U.S. Application Data

(60) Provisional application No. 61/149,960, filed on Feb. 4, 2009.

(51) Int. Cl.
*A41D 13/00* (2006.01)

(52) U.S. Cl.
USPC ..... 2/24; 2/22; 2/16

(58) Field of Classification Search
USPC ..... 2/16, 22, 23, 24, 455, 59, 62, 267, 227, 2/79
See application file for complete search history.

(56) References Cited

U.S. PATENT DOCUMENTS 4,561,123 A * 12/1985 Hull ..... 2/23
5,005,565 A * 4/1991 Fratesi ..... 602/16
5,105,473 A * 4/1992 Valtakari ..... 2/461
D351,255 S 10/1994 Pytlewski
5,405,312 A * 4/1995 Jacobs ..... 602/5
D360,286 S * 7/1995 Paffett et al. ..... D29/121.1
5,625,896 A * 5/1997 LaBarbera et al. ..... 2/22
5,680,657 A * 10/1997 Valtakari ..... 2/455
D393,141 S 4/1998 Glycenfer
D402,424 S * 12/1998 Jackson ..... D29/122
D404,173 S * 1/1999 Popowski ..... D29/121.1
D406,407 S * 3/1999 Popowski ..... D29/121.1
5,920,902 A 7/1999 Crampton
6,014,771 A 1/2000 Kirven
6,374,408 B1 * 4/2002 Tomlinson et al. ..... 2/22
D466,254 S * 11/2002 Hung ..... D29/121.1
D473,977 S 4/2003 Lesosky
6,751,804 B1 * 6/2004 Warner et al. ..... 2/23
6,817,029 B2 * 11/2004 Mazzarolo ..... 2/22
D516,254 S 2/2006 Shircliff (Continued)

OTHER PUBLICATIONS

"Knee Guard", web page printout from Lizard Skins web site, downloaded Feb. 3, 2009, 3 pp.

(Continued)

*Primary Examiner* — Khoa Huynh
*Assistant Examiner* — Andrew W Collins
(74) *Attorney, Agent, or Firm* — Stiennon & Stiennon

(57) ABSTRACT

A garment such as a shirt or pants has a front layer with portions which define a central opening defined by an inner periphery and positionable to overlie a portion of the joint to be protected such as a knee or an elbow. A removable protective insert is larger than the central opening and has a unitary cap sewn thereto. The cap has an upper segment separated from a lower segment by a bending joint defined by at least one groove which extends substantially across the cap. The upper segment and the lower segment are separately fixed to the protective insert by stitching. The upper segment and the lower segment have an outwardly projecting flange which overlies the protective insert, the flange having portions which engage the front layer of the garment between the cap flange and the protective insert. A slot in the insert ventilates through the front layer.

7 Claims, 3 Drawing Sheets

(56) References Cited

U.S. PATENT DOCUMENTS

| | | | | |
|---|---|---|---|---|
| 7,020,896 | B2 | 4/2006 | Davis | |
| 7,062,787 | B1 | 6/2006 | Shircliff | |
| 7,237,270 | B2 | 7/2007 | Crye et al. | |
| D588,310 | S | 3/2009 | Dancyger et al. | |
| D602,210 | S | 10/2009 | Crye | |
| 7,841,018 | B2 * | 11/2010 | Kotoske | 2/22 |
| 2003/0019006 | A1 * | 1/2003 | Godshaw et al. | 2/24 |
| 2004/0019949 | A1 * | 2/2004 | Crockett | 2/23 |
| 2004/0083527 | A1 * | 5/2004 | Budda | 2/22 |
| 2006/0005292 | A1 * | 1/2006 | Crye et al. | 2/24 |
| 2006/0026732 | A1 * | 2/2006 | Nordt et al. | 2/69 |
| 2006/0107433 | A1 * | 5/2006 | Olson | 2/22 |
| 2007/0261149 | A1 * | 11/2007 | Gait | 2/16 |
| 2007/0289051 | A1 * | 12/2007 | Ronco | 2/459 |
| 2008/0184467 | A1 * | 8/2008 | Brassill | 2/455 |
| 2008/0209607 | A1 * | 9/2008 | Kohler | 2/16 |
| 2008/0222767 | A1 * | 9/2008 | Williams | 2/24 |
| 2008/0289072 | A1 | 11/2008 | Shin | |

OTHER PUBLICATIONS

"DeWalt Knee Pad Inserts", web page printout, downloaded Feb. 3, 2009, 2 pp.

"Knee Pad Inserts for ACU Pants", web page printout from Ranger Joe's web site, downloaded Feb. 3, 2009, 3 pp.

"Husky UltraFlex® Gel Kneepads", web page printout from Homedepot web site, downloaded Feb. 3, 2009, 3 pp.

"DeWalt Multi Pocket Trousers", web page printout, downloaded Feb. 3, 2009, 2 pp.

* cited by examiner

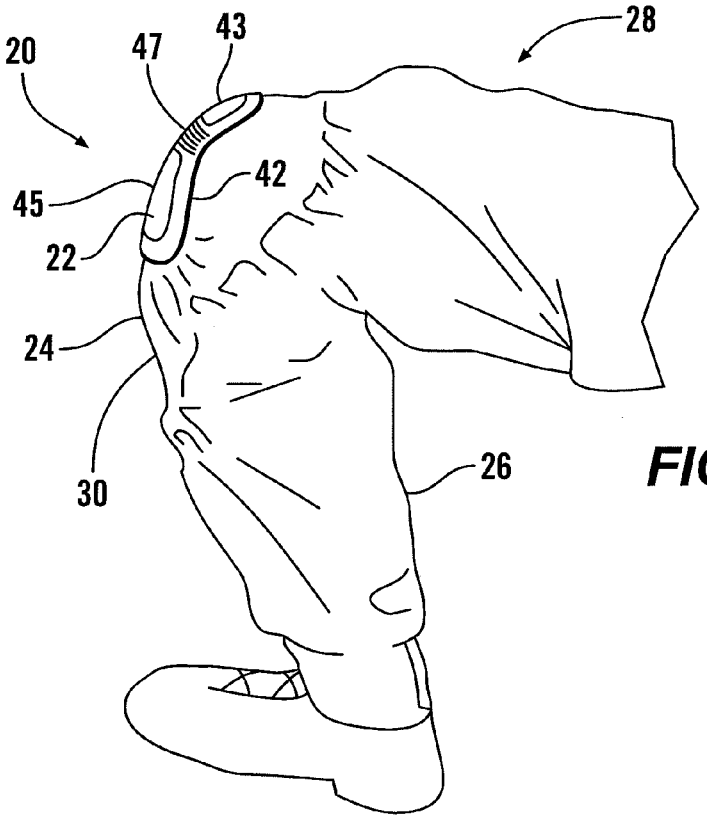
FIG. 4
FIG. 5
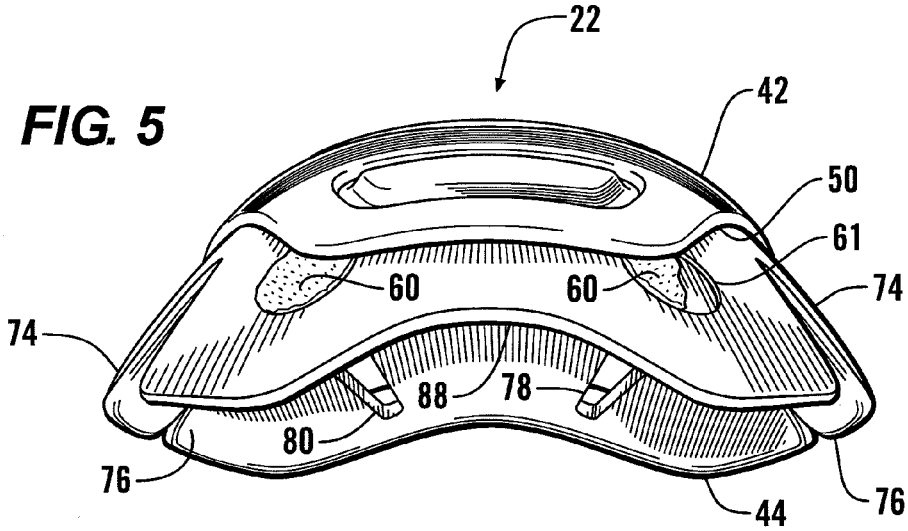

GARMENT PROTECTIVE ASSEMBLY

CROSS REFERENCES TO RELATED APPLICATIONS

This application claims the benefit of U.S. provisional app. No. 61/149,960, filed Feb. 4, 2009, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to protective clothing in general, and more particularly to garments which incorporate pads for protection of the wearer's joints such as elbows and knees.

There are many activities which require practitioners to take on cramped or reduced postures, such as crouching, crawling or lying prone, either momentarily or for extended periods. Moreover, it is sometimes necessary to assume these positions rapidly or unexpectedly. Kneeling and crawling, or collapsing to the knees, can be particularly injurious to the knees, either as a result of abrasion in the form of scraping, cutting, or puncturing, or as a result of impact or trauma. Flooring installers, carpenters, plumbers, and electricians are examples of tradesman who must occasionally or regularly spend time on their knees. Police officers, customs officials, and soldiers also are frequently required to kneel, crouch, or crawl, and often instantaneously in response to a sudden threat. Certain sporting and leisure activities can also lead to joint injuries if precautions are not taken.

Conventional knee and elbow pads provide some measure of protection against impact by supplying a cushion over the joint. In addition, the force of a point impact can be distributed over a greater surface area by stiff shells which are fastened to the cushion. The stiff shells also provide protection against minor cuts and abrasions, while at the same time protecting the cushion itself from degradation.

Elbow and knee pads are commonly of one of two types. Independent pads are mounted directly to the wearer's limbs by straps or belts. These devices offer the advantage of being securely attached in the vicinity of the joint to be protected, and being readily replaced for cleaning or repair. This type of pad is often employed where the wearer is otherwise lightly clad, such as in certain sporting activities. However, the tight elastic straps can be uncomfortable or can limit mobility. Moreover, the close-fitting pads can be especially hot during extended wear. In addition, the independent pads can be difficult to combine with other necessary garments, such as coveralls, fatigues, or jumpsuits, as the padding may, when used in combination with such clothing, restrict movement and ventilation and interfere with the garment. Furthermore, the hard shell of an independent pad, if worn interior to the garment, can result in the shredding or abrasion of the garment itself, which is caught between the hard shell of the pad and the hard exterior objects. If worn exterior to the garment, the pad can be excessively restrictive of the movement of the garment, and impair the mobility of the wearer.

Garment-mounted pads are often more comfortable, and the hard shell of the pad worn on the exterior of the garment fabric serves to extend the life of the garment itself. Garment and pad wear may, however, progress at different rates, and it may be desirable to replace one and not the other. Or, it may be necessary to remove any foam padding in order to adequately wash the garment, or to safely subject the garment to drying heat. Some garments have pockets into which the foam pad is inserted, but if the hard shell is also inserted into this type of pocket, it would no longer provide protection for the garment fabric.

U.S. Pat. No. 7,237,270, entitled Removable Garment Protective Assembly, discloses a joint protective pad assembly in which a protective element comprised of a foam pad and a cap is received within a frontwardly opening pocket in a garment. The protective plastic cap is stitched to the pad around a center region, such that a projecting flange is defined which overlies the pad. The margin of the pocket opening is received between the cap flange and the pad, and thereby retains the protective element in place while in use, yet allows the protective element to be readily removed for washing of the garment, or for replacement. In one embodiment two stiff caps are sewn to the foam pad and are received within two pockets. Yet even greater levels of comfort and protective efficacy are desirable, without sacrificing the convenience features of such a protective assembly.

SUMMARY OF THE INVENTION

A garment protective assembly of this invention works to protect a wearer's joint, such as a knee or elbow, and is incorporated in a garment such as a shirt or pants. The garment has a front layer with portions which define a central opening defined by an inner periphery and positionable to overlie a portion of the joint to be protected. A removable protective insert is larger than the central opening and may be formed of resilient foam. A stiffer unitary cap is sewn to the insert. The molded cap has an upper segment separated from a lower segment by a bending joint defined by at least one groove which extends substantially across the cap. The upper segment and the lower segment are separately fixed to the protective insert by stitching. The upper segment and the lower segment have an outwardly projecting flange which overlies the protective insert, the flange having portions which engage the front layer of the garment between the cap flange and the protective insert.

The foam insert is die cut to form two sided diverging notches, one on either side of the cap, and aligned with the bending joint, which facilitate the bending of the protective insert. The wearer's comfort and freedom of movement is further aided by two notches positioned downwardly from the cap.

The foam insert has two elongated slots which pierce the protective insert to permit air flow therethrough. A relief is associated with each slot which extends from a protective insert front surface to the slot, such that an air cavity is defined between the garment front layer and the slot. The garment front layer overlies each air cavity to permit ventilation therethrough to the protected joint.

It is an object of the present invention to provide a garment protective assembly which is less restrictive of the wearer's movements.

It is another object of the present invention to provide a garment protective assembly which facilitates air flow to the protected joint.

It is a further object of the present invention to provide a garment protective assembly configured for wearer comfort.

Further objects, features and advantages of the invention will be apparent from the following detailed description when taken in conjunction with the accompanying drawings.

BRIEF DESCRIPTION OF THE DRAWINGS

FIG. 4 is a fragmentary side perspective view of the protective assembly of FIG. 1 shown in use with the wearer's knee bent.

FIG. 5 is a top plan view of the protective insert of FIG. 1.

DESCRIPTION OF THE PREFERRED EMBODIMENTS

Figure 1:
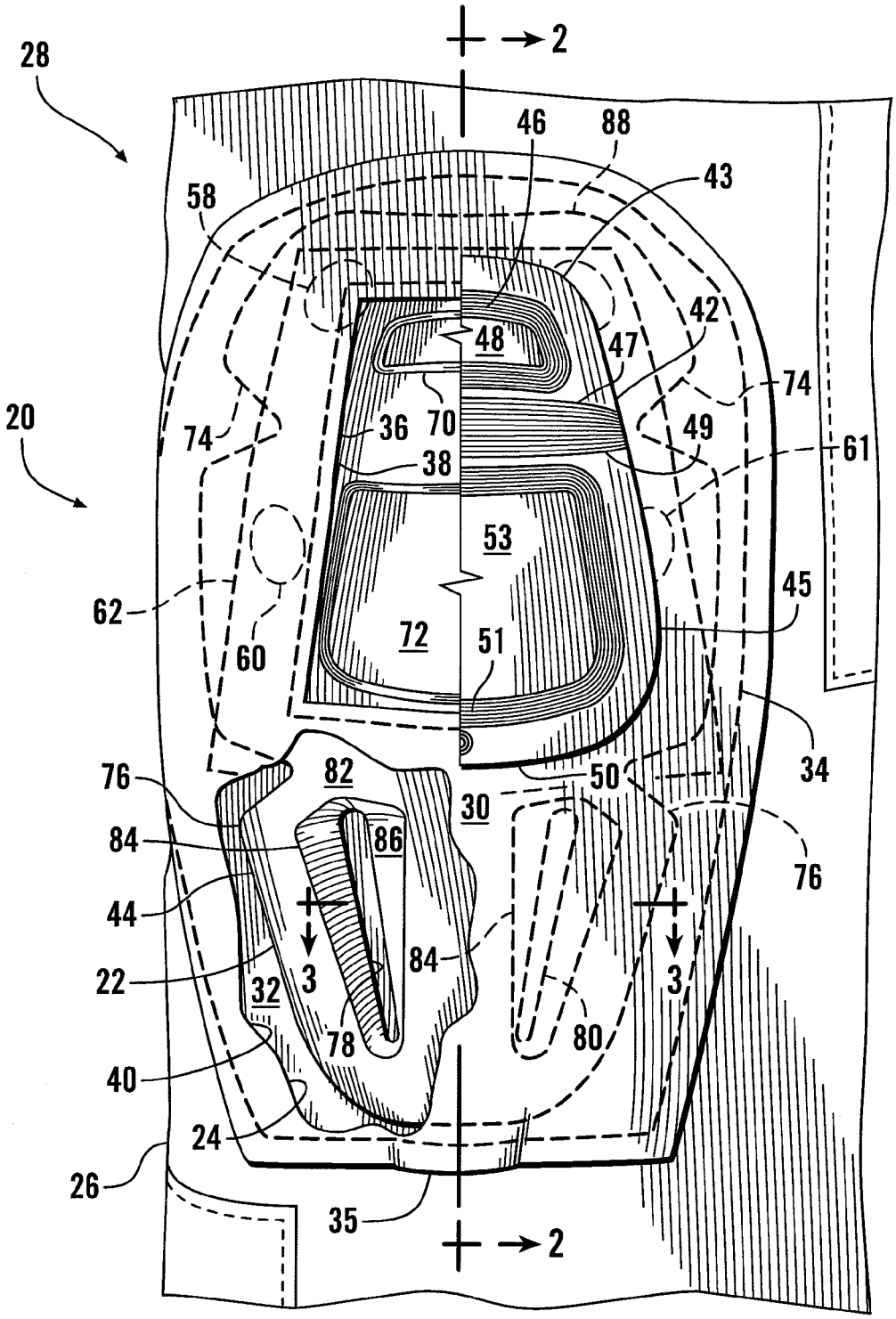
FIG. 1 is a front elevational view, partially broken away in section of the joint protective assembly of this invention configured for protection of the knee of the wearer of a garment.
Figure 2:
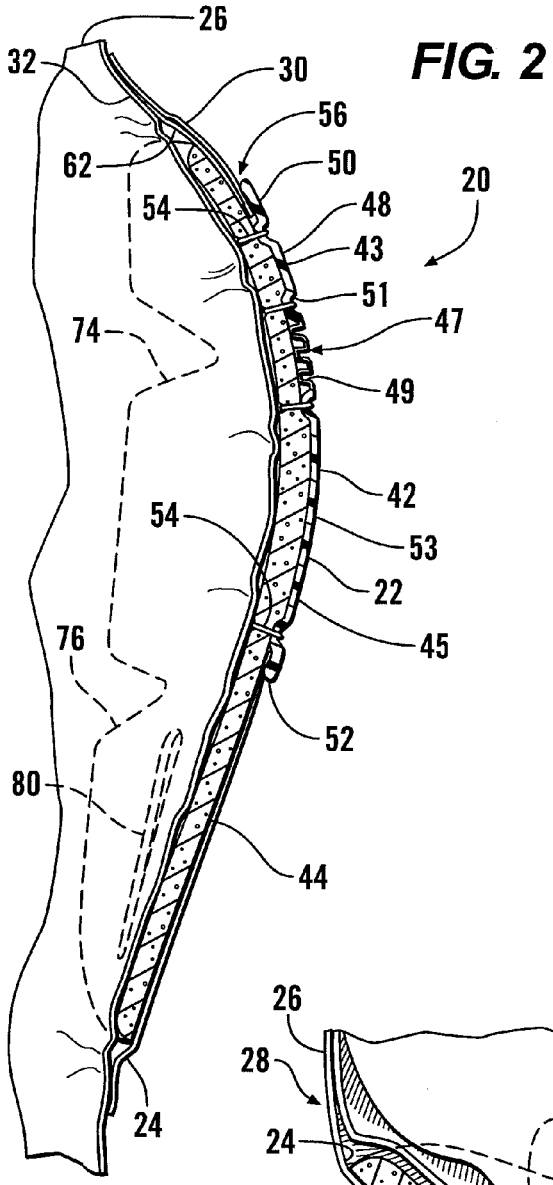
FIG. 2 is a fragmentary cross-sectional view of the assembly of FIG. 1 taken along section line 2-2.

Referring more particularly to FIGS. 1-5, wherein like numbers refer to similar parts, a protective pad assembly 20 is shown in FIGS. 1-4. The protective pad assembly 20 is comprised of a protective element 22, and a pocket 24 formed on a pants leg 26 of a garment 28, for example a soldier's fatigues. The protective element 22 is symmetrical about a vertical axis, and has a cap 42 attached to an insert 44. In FIG. 1, the cap 42 is shown broken away generally about the vertical axis. The pocket 24 is accessible through a central opening 36, and is not open at the top or sides as in a common pocket. Other pocket configurations may be employed, such as the ones shown in U.S. Pat. No. 7,237,270, the disclosure of which is incorporated by reference herein. As shown in FIG. 2, the pocket 24 is defined between a fabric front layer 30 and a frontwardly facing fabric substrate 32 of the garment 28. The protective pad assembly illustrated is a knee pad assembly, but a similar arrangement for an elbow or other body area may be provided.

As shown in FIG. 1, the front layer 30 is connected to the garment substrate 32 at an outer peripheral seam 34, formed, for example, by stitching. The seam 34 may be broken at an access region 35 at the base of the pocket, to aid in removal of the insert by insertion of a finger to press up on the insert. The central opening 36 is defined in the front layer 30 and has an inner periphery 38 which may be finished by a sewn seam. It will be noted that the front layer 30 does not lie flat against the garment substrate 32, but is spaced from the substrate to define a pocket interior cavity 40 which is dimensioned to snugly receive portions of the protective element 22. The pocket 24 permits the insertion of portions of the protective element 22 through the frontwardly facing central opening 36.

The protective element 22 has a stiff but bendable cap 42 which is connected to a protective cushioning insert 44. The insert is a tapered molded and cut sheet of cushioning material. The insert 44 is generally resilient and may be dual density polyethylene/EVA foam. If the initial foam sheet is ½ inch thick, the molded and cut sheet may range in thickness from ½ inch to 1/16 inch. To facilitate attachment of the cap 42 to the foam insert sheet 44 by stitching, the foam sheet is preferably produced as a fabric/foam/fabric laminate. Although the front surface need not be fabric covered, the fabric may be provided to provide a more finished appearance. The shape is given to the foam insert sheet 44 by placing it in a compression mold, and forming it with heat and pressure into the desired three-dimensional shape. The molded shape is then placed in a die cutting apparatus to trim and perforate the part. To facilitate the die cutting, the molded sheet is preferably first flattened out to aid in cutting. The foam has a low density, preferably about two pounds per cubic foot or less.

The stiff cap 42 may be fabricated of a thermoplastic elastomer such as SANTOPRENE® plastic material manufactured by Advanced Elastomer Systems of Exxon Mobil Corporation. This plastic material, although stiffer than most rubbers, nonetheless is generally softer than a plastic such as polyethylene. The stiff cap 42 may be a molded material, which preferably has a slightly convex shape to give strength and stiffness and selected to protect the joint for which it is intended. It will be noted that the stiff cap 42 has some resilience, permitting bending of portions of the cap.

The cap 42 is formed as a unitary molded part, and has an upper segment 43 separated from a lower segment 45 by a bending joint 47 defined by at least one, and preferably three grooves 49 which extend substantially across the cap. Each groove 49 may be about ⅛ inch across, and about ⅛ inch deep at the midpoint of the cap, and may taper to a reduced or minimal depth at the edges of the cap. As shown in FIG. 1, the middle of the three grooves 49 may extend substantially horizontally across the cap 42, while the upper groove may curve downwardly, and the lower groove may curve upwardly. The total distance between the upper segment center 48 and the lower segment center 53 may be approximately one inch.

As best shown in FIG. 1, each segment 43, 45 of the cap 42 has formed therein shallow peripheral grooves 46, 51 which encircle the segment centers 48, 53. The peripheral grooves 46, 51 permit a thread 54 to be stitched through the cap and the cushioning insert 44, thereby connecting the cap 42 to the protective cushioning insert 44 without the thread protruding outwardly from the cap. Both segments 43, 45, are thus independently fixed to the protective insert 44 on either side of the bending joint, to allow the flexing of the cap along the bending joint. In the illustrated knee pad, the upper segment may be smaller than the lower segment, for example a little less than one half the height of the lower segment. The cushioning insert 44 may be molded to have protruding regions 70, 72, corresponding in shape to the segment centers 48, 53, to aid in the positioning and attachment of the cap 42 to the insert 44.

Figure 3:
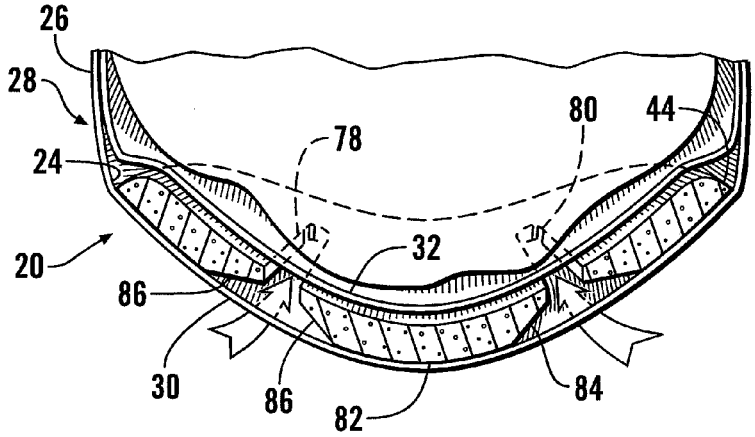
FIG. 3 is a fragmentary cross-sectional view of the assembly of FIG. 1 taken along section line 3-3.

A flange 50, about one-half inch wide, extends outwardly exterior to the grooves 46, 51. As shown in FIG. 3, the back side of the flange 50 is preferably formed with a narrow peripheral ridge 52 which is approximately a semicylindrical bead which faces toward the pocket front layer 30 from the outside. Other effective connection mechanisms between the cap and the insert 44 may be employed, so long as the outward protrusion of the flange 50 remains. The flange 50 is thus not fixed to the insert 44 outwardly of the grooves 46, 51, with the result that a gap 56 is defined between the cap and the insert 44.

In use, the insert 44 is inserted into the interior cavity 40 of the pocket 24 such that the inner periphery 38 of the pocket front layer 30 is received within the gap 56 between the cap 42 flange 50 and the insert 44. The cap 42 engages the material of the front layer 30, and thereby holds the protective element 22 in place. The insert 44 may be substantially larger than the cap 42. For example, a cap 42 which is about four inches wide and six inches high, may be connected to an insert which is about 6½ inches wide and ten inches high. The cap 42 may be positioned closer to the top of the insert 44 than to the bottom. To attach the protective element 22 to the garment 28, the protective element is held so that the downwardly tapered insert 44 is compressed to pass through the central opening 36. The insert 44 is advanced until the fabric of the pocket front layer 30 is received in the gap 56 beneath the beadlike ridge 52 on the rear of the cap flange 50. The insert 44, which is readily compressed and distorted, is then worked around the perimeter of the cap 42 so the edge of the pocket front layer goes under the cap flange.

Any tendency for the upper portion of the insert 44 to move downward in the pocket as the wearer's joint is flexed may be resisted by a two-part fastener extending between the insert 44 and the pocket front layer 30. The two-part fastener may be a hook-and-loop fastener 58 such as VELCRO® fastener from Velcro Industries B.V., or another conventional fastener such as a snap fastener having a socket as one part, and a stud as the other part. The fastener 58 has an insert portion 60 facing frontwardly and affixed to the insert 44 above the cap, and a pocket portion 62 affixed to the pocket front layer 30 inside the pocket and facing the garment substrate 32. When the insert 44 is in position within the pocket 24, the two strips of hook-and-loop fastener 58 are engaged with one another to retain the protective element 22 in place. As shown in FIG. 1, the insert fastener portions 60 may be formed as ⅞ inch circular units which are adhesively fastened within shallow depressions 61 molded into the insert 44. The recessed depressions 61 help to hold the fastener portions in place over time.

As shown in FIG. 4, when a wearer of the garment 28 kneels or bends a knee, the pants leg 26 embodying the protective pad assembly 20 will be distorted, and the protective element 22 will tend to restrict the distortion of the garment. To the extent this restriction in minimized, the wearer will experience a minimum of discomfort or interference as a result of using the protective pad assembly. Hence the protective pad assembly 20 is configured with features which facilitate the conformance of the assembly to the wearer's limb as its position changes. Two sets of notches with diverging walls are die-cut into the perimeter of the protective insert, as best shown in FIG. 1. Upper notches 74 are positioned one on either side of the cap 42, and aligned with the bending joint 47 of the cap, to thereby facilitate bending of the protective insert 44 as the cap is bent about the bending joint. Each notch has a narrowest point which is preferably aligned with the centermost of the grooves 49 of the bending joint 47. Lower notches 76 are located on the protective insert one on either side of and spaced downwardly from the cap 42, to thereby facilitate bending of the protective insert along a bend line spaced downwardly from the cap. Both sets of notches 74, 76, are thus positioned behind the garment front layer, and thereby protected from contact with the exterior environment.

It will be expected that wearers of the garment protective joint assembly 20 of this invention will be involved in active endeavors such as running, kneeling, carrying out manual chores, etc. As a result, the wearer will generate body heat which it is desirable to bring into contact with cooling external air. Hence the assembly 20 is fabricated to allow air to flow through the insert 44 and carry away heat from the protected joint. As shown in FIG. 1, two elongated slots 78, 80 are spaced downwardly of the cap, and pierce the protective insert 44 and permit air to flow therethrough. The slots 78, 80 are spaced from each other on either side of a vertical centerline of the insert 44. The slots may be about ¼ inch wide, and about 2⅛ inches long, with rounded ends. Although more slots provide more air flow, greater space devoted to slots reduces the cushioning material available to protect the wearer's joint. Therefore it is desirable to not have too much of the surface area devoted to slots. As shown in FIG. 4, the fabric front layer 30 will tend to be stretched across the front surface 82 of the insert 44. As shown in FIG. 3, the fabric front layer 30, which is pervious to air, thus overlies the slots 78, 80. Yet to provide a wider air channel into each slot, the protective insert is molded to define a relief 84 which extends from the front surface 82 to the slot to thus define an air cavity between the garment front layer 30 and the slot, permitting ventilation through the insert to the protected joint. Each relief 84 has inclined or ramped side walls 86. The relief may be from one-half to one-and-one-quarter inches across.

As shown in FIG. 5, the protective foam insert is preferably molded and cut to have an upper edge 88 which is concave towards the wearer, so that the upper edge conforms better to the wearer, and thus tends less to interfere with the wearer's movements, and thus adds to comfortable wear of the assembly.

It is understood that the invention is not limited to the particular construction and arrangement of parts herein illustrated and described, but embraces all such modified forms thereof as come within the scope of the following claims.

I claim:

1. In a garment protective joint assembly having a garment with a front layer with portions which define a central opening defined by an inner periphery and positionable to overlie a portion of the joint which is to be protected; a foam protective insert being larger than the central opening; and a unitary cap fixed to the protective insert, the cap having portions which define an outwardly projecting flange which overlies the protective insert, the flange having portions which engage the front layer of the garment to engage the front layer of the garment between the cap flange and the protective insert, and the insert being thus removably connected to the garment; wherein the improvement comprises:

the unitary cap having an upper segment separated from a lower segment by a bending joint defined by at least one groove which extends substantially across the cap, wherein the upper segment is stitched to the protective insert, and wherein the lower segment is separately stitched to the protective insert.

2. In a garment protective joint assembly having a garment having an air pervious front layer with portions which define a central opening defined by an inner periphery and positionable to overlie a portion of the joint which is to be protected, a protective insert which is larger than the central opening and which has a front surface which faces the garment front layer, and a unitary cap fixed to the protective insert to define an outwardly projecting flange which overlies the protective insert, the flange having portions which engage the front layer of the garment between the cap flange and the protective insert, and the insert being thus removably connected to the garment, the protective insert extending from the cap to extend rearwardly of the garment front layer, wherein the improvement comprises:

portions of the protective insert which define an elongated first slot having a width and being spaced outwardly from the cap, the slot piercing the protective insert to permit air flow therethrough; wherein the first slot extends away from the unitary cap a distance greater than the slot width; and portions of the protective insert which define a relief which extends from the protective insert front surface to the first slot, such that an air cavity is defined between the garment front layer and the first slot, the garment front layer overlying the air cavity to permit ventilation therethrough to the protected joint.

3. The garment protective joint assembly of claim 1 further comprising portions of the protective insert which define two opposed notches, one on either side of the cap, and positioned aligned with the bending joint of the cap, to thereby facilitate bending of the protective insert as the cap is bent about the bending joint.

4. A garment protective joint assembly of claim 1 further comprising portions of the protective insert which define two opposed notches, one on either side of and spaced downwardly from the cap, to thereby facilitate bending of the protective insert along a bend line spaced downwardly from the cap, the notches being enclosed rearwardly of the garment front layer.

5. The garment protective joint assembly of claim 1 wherein the garment front layer has a rearwardly facing surface, and wherein the protective insert has a frontwardly facing surface, and further comprising a plurality of recesses defined by portions of the protective insert, the recesses extending rearwardly away from the garment front layer, and wherein a first part of a two-part hook and loop fastener material is affixed to the garment front layer rearwardly facing surface, and a second part of the two-part hook and loop fastener is affixed to the protective insert within each of the recesses for engagement of said first part.

6. The garment protective joint assembly of claim 2 further comprising:

portions of the protective insert which define an elongated second slot having a width and being spaced from the first slot, the second slot piercing the protective insert to permit air flow therethrough; wherein the second slot extends away from the unitary cap a distance greater than the second slot width; and portions of the protective insert which define a second relief which extends from the protective insert front surface to the second slot, such that a second air cavity is defined between the garment front layer and the second slot, the garment front layer overlying the second air cavity to permit ventilation therethrough to the protected joint, wherein the insert has a width and a height which is greater than the width, and wherein the first slot and the second slot lie on opposite sides of a line bisecting the insert and extending the height of the insert.

7. The garment protective joint assembly of claim 2 wherein the relief has a width, and wherein the width of the relief is from 2 to 5 times the width of the first slot.

* * * * *